US005144808A

United States Patent [19]

Ha

[11] Patent Number: 5,144,808

[45] Date of Patent: Sep. 8, 1992

[54] CRYOGENIC AIR SEPARATION PROCESS AND APPARATUS

[75] Inventor: Bao V. Ha, San Jose, Calif.

[73] Assignee: Liquid Air Engineering Corporation, Walnut Creek, Calif.

[21] Appl. No.: 651,359

[22] PCT Filed: Sep. 12, 1989

[86] PCT No.: PCT/US89/03926

§ 371 Date: Feb. 12, 1991

§ 102(e) Date: Feb. 12, 1991

[87] PCT Pub. No.: WO86/02148

PCT Pub. Date: Apr. 10, 1986

[51] Int. Cl.[5] ..... F25J 3/02

[52] U.S. Cl. ..... 62/24; 62/28; 62/41; 62/42; /

[58] Field of Search ..... 62/23, 24, 27, 28, 41, 62/42

[56] References Cited

U.S. PATENT DOCUMENTS

| | | | |
|---|---|---|---|
| 3,500,651 | 3/1970 | Becker | 62/29 |
| 4,022,030 | 5/1977 | Brugerolle | 62/30 |
| 4,088,464 | 5/1978 | Bigi | 62/22 |
| 4,099,945 | 7/1978 | Aktiengesellschaft | 62/30 |
| 4,372,765 | 2/1983 | Tamura et al. | 62/29 |
| 4,410,343 | 10/1983 | Ziemer | 62/43 |
| 4,507,134 | 3/1985 | Tomisaka | 62/43 |
| 4,526,595 | 7/1985 | McNeil | 62/28 |
| 4,529,425 | 1/1986 | McNeil | 62/37 |
| 4,566,887 | 1/1986 | Openshaw | 62/21 |
| 4,617,036 | 10/1986 | Suchdeo et al. | 62/11 |
| 4,617,037 | 10/1986 | Okada et al. | 62/11 |
| 4,617,040 | 10/1986 | Yoshino | 62/37 |
| 4,668,260 | 5/1987 | Yoshino | 62/11 |
| 4,671,813 | 3/1987 | Yoshino | 62/32 |
| 4,698,079 | 7/1987 | Yoshino | 62/11 |
| 4,715,873 | 4/1987 | Auvil et al. | 62/13 |
| 4,732,595 | 8/1988 | Yoshino | 62/11 |
| 4,769,055 | 2/1988 | Erickson | 62/22 |

*Primary Examiner*—Ronald C. Capossela

[57] ABSTRACT

An energy efficient process and apparatus for the cryogenic separation of air by rectification to produce at least one vapor fraction, at least one liquid fraction, and at least one nitrogen product stream wherein cooled and pressurized feed air in vapor form is condensed by indirect heat exchange contact with at least one liquid fraction to vaporize the liquid fraction and condense the feed air stream, then vaporizing the condensed feed air stream by indirect heat exchange contact with at least one vapor fraction thereby condensing the vapor fraction, and then using the vaporized feed air stream as feed air for cryogenic separation by rectification.

21 Claims, 4 Drawing Sheets

CRYOGENIC AIR SEPARATION PROCESS AND APPARATUS

TECHNICAL FIELD OF THE INVENTION

This invention relates to the field of air separation processes and particularly to a process and apparatus for the production of nitrogen, oxygen and/or argon from air wherein liquefied air is used as the heat exchange medium for the high pressure column condenser to provide an energy efficient process.

BACKGROUND ART

Standard cryogenic air separation processes involve filtering of feed air to remove particulate matter followed by compression of the air to supply energy for separation. Generally the feed air stream is then cooled and passed through absorbents to remove contaminants such as carbon dioxide and water vapor. The resulting stream is subjected to cryogenic distillation.

Cryogenic distillation or air separation includes feeding the high pressure air into one or more separation columns which are operated at cryogenic temperatures whereby the air components including oxygen, nitrogen, argon, and the rare gases can be separated by distillation.

Cryogenic separation processes involving vapor and liquid contact depend on the differences in vapor pressure for the respective components. The component having the higher vapor pressure, meaning that it is more volatile or lower boiling, has a tendency to concentrate in the vapor phase. The component having the lower vapor pressure meaning that it is less volatile or higher boiling tends to concentrate in the liquid phase.

The separation process in which there is heating of a liquid mixture to concentrate the volatile components in the vapor phase and the less volatile components in the liquid phase defines distillation. Partial condensation is a separation process in which a vapor mixture is cooled to concentrate the volatile component or components in the vapor phase and at the same time concentrate the less volatile component or components in the liquid phase.

A process which combines successive partial vaporizations and condensations involving countercurrent treatment of the vapor in liquid phases is called rectification or sometimes called continuous distillation. The countercurrent contacting of the vapor and liquid phases is adiabatic and can include integral or differential contact between the phases.

Apparatus used to achieve separation processes utilizing the principles of rectification to separate mixtures are often called rectification columns, distillation columns, or fractionation columns.

When used herein and in the claims, the term "column" designates a distillation or fractionation column or zone. It can also be described as a contacting column or zone wherein liquid or vapor phases are countercurrently contacted for purposes of separating a fluid mixture. By way of example this would include contacting of the vapor and liquid phases on a series of vertically spaced trays or plates which are often perforated and corrugated and which extend crosswise of the column, perpendicular to the central axis. In place of the trays or plates there can be used packing elements to fill the column.

"Double column" as used herein refers to a higher pressure column having its upper end in heat exchange relation with the lower end of a lower pressure column.

The term "a standard air separation process or apparatus" as used herein is meant to describe that process and apparatus as above described as well as other air separation processes well known to those skilled in the art.

As used herein and in the appended claims, the term "indirect heat exchange" means the bringing of two fluid streams into heat exchange relation without any physical contact or intermixing of the fluids with each other.

Historically, nitrogen, oxygen and/or argon have been produced by one of two basic process schemes including the single column process and the double column process.

With respect to nitrogen, the single column process produces good quality gaseous and liquid nitrogen at pressures of approximately 6–10 bar. The recovery of nitrogen is limited by the equilibrium at the bottom of the column. Typically, the process can produce nitrogen at a rate of approximately 50–60% of the nitrogen in the initial air feed.

With the double column process, nitrogen is produced at pressures of about 1–4 bar. It is more efficient than the single column process, and approximately 90% or more of nitrogen can be recovered from the nitrogen present in the initial air feed. Typically the columns are stacked with a condenser-reboiler separating the two columns. Since the process produces nitrogen at relatively low pressures, further compression of nitrogen is frequently needed adding to the cost of production and use.

In the prior art double column process, air is separated by cryogenic distillation or rectification to produce a nitrogen-rich stream or fraction at the top of the high pressure column and oxygen-rich stream or fraction at the bottom. The nitrogen-rich stream is sent to the top of the low pressure column to provide the reflux for this column. The bottom oxygen-rich stream is fed to the low pressure column for further separation.

In the low pressure column the feed stream is further separated by cryogenic distillation into an oxygen-rich stream or fraction at the bottom and a nitrogen-rich stream or fraction at the top. The top stream can then be recovered as nitrogen product. In the double column arrangement, the high pressure column and the low pressure column are thermally linked through the condenser-reboiler arrangement. Thus, in the prior art double column process the nitrogen-rich fraction of the high pressure column is condensed against the vaporizing oxygen-rich fraction of the low pressure column.

For a given pressure in the low pressure column, the pressure of the air feed to the high pressure column is dictated by the composition of the vaporizing oxygen-enriched stream, the temperature difference of the high pressure column condenser and the low pressure column reboiler, and to some extent the composition of the condensing nitrogen-enriched stream which is relatively pure in nitrogen.

Other prior art process schemes are variations of the above described single or double column process with additional features such as an additional overhead condenser or bottom reboiler.

SUMMARY OF THE INVENTION

The process of the invention can be utilized for the energy efficient production of nitrogen, oxygen and argon.

Essentially, the invention lies in using vaporized and liquefied air as the heating and cooling medium between the high pressure and the low pressure columns. Formerly nitrogen has been used.

The invention will be explained in particular detail with respect to nitrogen but it should be understood that the invention is equally applicable to the production of oxygen and argon. It will be obvious to those skilled in the art how to optimize temperature, pressure and other operating conditions to optimize output of oxygen and/or argon as primary product.

The particular advantage in the use of air for the heating and cooling medium is that less energy is required to condense the air than to condense a nitrogen rich stream. Since the main energy cost involves compression of the gases, the lower pressure which is required to condense air at a given temperature is less costly than to condense nitrogen.

For example, nitrogen condenses at 7 bar pressure at −180° C. By contrast, only 6 bar pressure at −178° C. is required to condense air. Thus the 2° C. difference in temperature and the 1 bar pressure provides the reduced energy expenditure in the invention process.

In prior art processes wherein nitrogen is used for the heating and cooling medium between the high pressure and low pressure columns, it is necessary to compress the feed air to a higher feed air pressure as required by the nitrogen. Thus, the primary energy savings come from the reduced requirement for compression of the feed air.

The process of the invention makes possible the production of high purity nitrogen to the extent of more than 90% of the nitrogen contained in the initial feed air. It can be produced at a pressure range within about 3 bar to about 15 bar. Both high pressure and low pressure nitrogen can be produced. This can be done separately or together. Moreover, the process is energy efficient compared with prior art processes.

According to the invention process, feed air, which has been treated to remove moisture and impurities such as $CO_2$ and methane by passage through molecular sieves, alumina, silica gel and the like is compressed and fed to a heat exchanger to exchange heat with outgoing products.

According to one embodiment, the feed air is split into two fractions, one fraction being fed to the bottom of a high pressure column and the other fraction being fed to a condenser/reboiler located in the base of a low pressure column. Good results have been obtained by using equal fractions of feed air although other ratios can be used.

According to another embodiment, the feed air is split into three fractions. Two of the feed air fractions are fed to the high pressure column and the condenser/reboiler at the base of the low pressure column as above described. The third air fraction is expanded to provide plant cooling and then introduced into the low pressure column for cryogenic separation.

The first feed air fraction is separated by cryogenic distillation within the high pressure column into a first nitrogen-rich vapor fraction and a first oxygen-rich liquid fraction. The oxygen enriched liquid fraction is withdrawn from the base of the high pressure column and sent to the low pressure column. The second feed air fraction which is sent to the condenser/reboiler in the base of the low pressure column is condensed by heat exchange with the oxygen-rich liquid at the bottom of the low pressure column which is thereby vaporized. The condensed liquefied air thus produced in the condenser/reboiler is then fed to the top condenser of the high pressure column where it is vaporized by indirect heat exchange with the first nitrogen-rich vapor fraction produced in the high pressure column. This causes the nitrogen to condense.

According to one embodiment, part of the condensed nitrogen-rich fraction in the high pressure column is separated and fed to the low pressure column to provide extra reflux. At the same time the second feed air fraction which has been vaporized by indirect heat exchange contact with nitrogen in the top condenser of the high pressure column is then introduced into the low pressure column for cryogenic separation.

Within the low pressure column, the second feed air fraction along with a portion of the first oxygen-rich fraction from the high pressure column are then separated into a second nitrogen-rich stream and a second oxygen-rich stream.

According to another embodiment, a portion of the second nitrogen-rich stream can be removed as high pressure nitrogen product while the remaining portion is used to provide reflux for the low pressure column.

According to another embodiment, a portion of the high pressure nitrogen product can be expanded to provide plant cooling and added to the low pressure nitrogen product stream.

The second oxygen-rich stream which falls to the bottom of the low pressure column is vaporized by indirect heat exchange contact with the incoming second feed air fraction which is thereby condensed. By another embodiment, the second oxygen-rich fraction can also include a third feed air fraction which has been expanded prior to being introduced into the low pressure column.

A portion of the second oxygen-rich stream is fed to the overhead condenser of the low pressure column where it is vaporized by heat exchange contact with rising nitrogen which is thereby condensed. The thus vaporized second oxygen-rich stream can be removed from the overhead condenser as waste and warmed in subcoolers and in the heat exchanger by indirect heat exchange with process streams and feed air.

If desired the waste oxygen can be expanded to provide plant cooling. Alternately, the waste oxygen which has about 70% purity can be utilized as product in applications where high purity oxygen is not required.

Apparatus for the above described process are also provided. The apparatus include, in combination, air compression means for compressing air from an outside source, purification means for removing carbon dioxide and water vapor from the air compressed by the air compression means, and heat exchange means for cooling the compressed air from the purification means to a cryogenic temperature. A first distillation column equipped with a top column or overhead evaporator/condenser is included for cryogenic separation of a portion of the feed air from the heat exchanger.

A second distillation column equipped with a top column condenser and a bottom column reboiler is provided for separation by fractionation of at least a portion of the cooled compressed feed air after circulation through the bottom column reboiler of the second distillation column and the top column condenser of the first distillation column together with at least a portion of the oxygen-rich liquid obtained from the first distillation column into a second oxygen-rich fraction and a second nitrogen-rich fraction.

Means are provided for withdrawal of oxygen liquid at the base of the second distillation column for introduction into the overhead condenser of the second distillation column to provide indirect heat exchange with vapors rising within the second distillation column.

Expansion means are provided for expansion of compressed air prior to introduction in the second distillation column, of oxygen withdrawn from the overhead condenser of the second distillation column, and/or for expansion of nitrogen product to provide cooling.

DETAILED DESCRIPTION OF THE INVENTION

Figure 1:
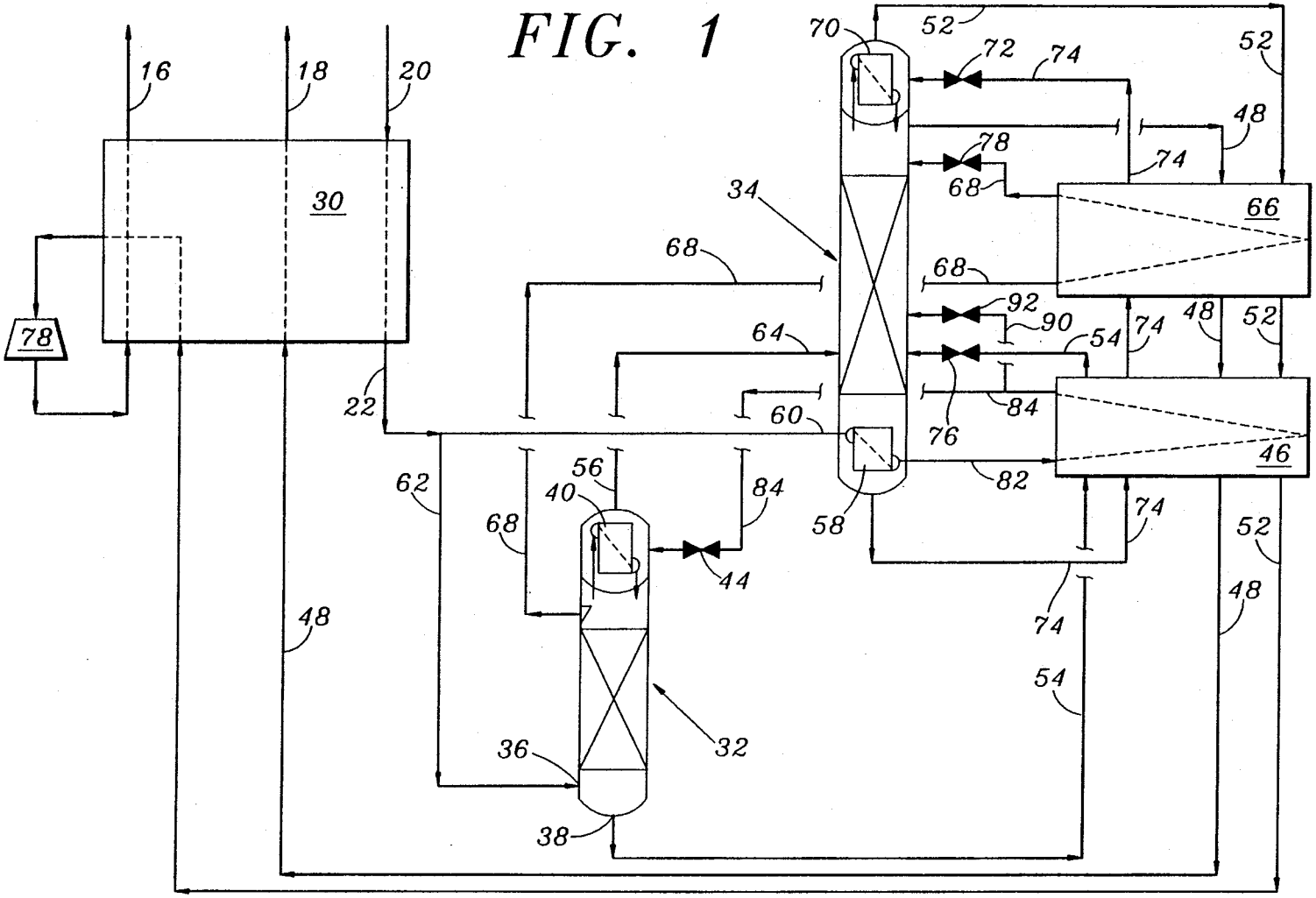
FIG. 1 shows a schematic flow diagram of the process and apparatus of the invention in which low pressure nitrogen is produced.
Figure 2:
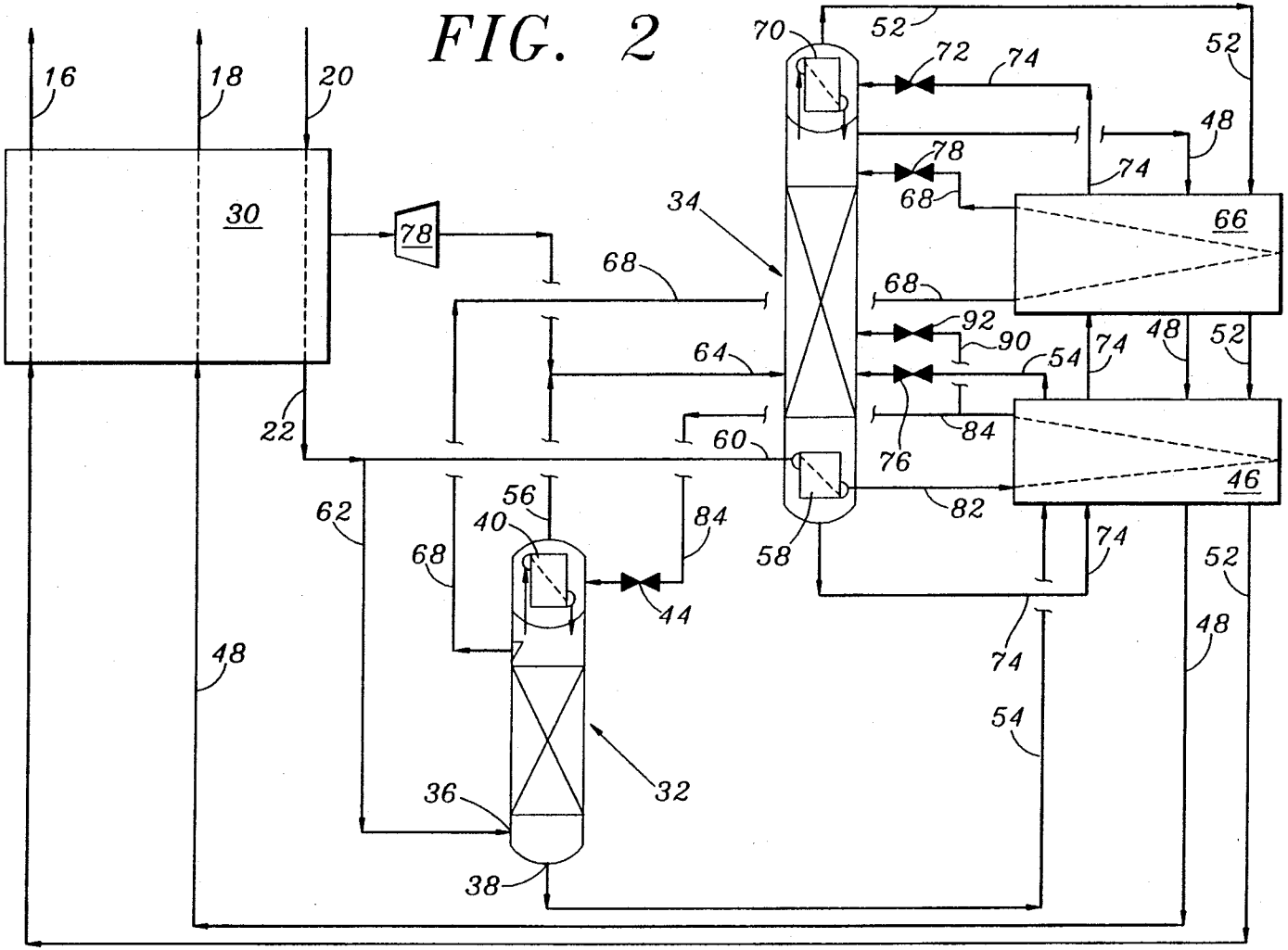
FIG. 2 shows a schematic flow diagram of the process and apparatus of the invention similar to FIG. 1 except that air expansion is provided in place of waste expansion.

Referring now to the flow diagram of FIG. 1, compressed feed air free of impurities is introduced by means of conduit 20 into a heat exchanger 30. The air is preferably introduced into the heat exchanger 30 at a pressure in the range of about 5 bar to about 20 bar where the temperature of the air is cooled to cryogenic temperature by indirect heat exchange with outgoing waste and product streams.

Next the feed air is split into two fractions. Good results have been obtained with equal fractions or streams of feed air but other ratios can be used. The first fraction of the feed air is sent to the high pressure column 32 through lines 22 and 62 and the remaining second fraction of feed air is sent to the reboiler 58 of the low pressure column 34 through lines 22 and 60.

At the high pressure column 32 the pressure is preferably in the range of about 5 bar to 20 bar.

The first feed air fraction is introduced into the lower part of column 32 below the bottom distillation tray as indicated at 36. Here, the first feed air fraction is separated into a first nitrogen-rich vapor fraction which rises to the top of the column 32 and a first oxygen-rich liquid fraction which falls to the bottom of the column 32.

At least a portion of the first oxygen-rich liquid is withdrawn from the bottom of the high pressure column at 38. It is comprised of about 35% to about 40% oxygen which is about the same proportion as for the prior art processes.

The first oxygen-rich liquid which is removed from the bottom of the high pressure column 32 through line 54 is passed through subcooler 46 where the temperature is further reduced by indirect heat exchange with product nitrogen which exits from the upper part of the low pressure column 34 through line 48 and with waste which exits through line 52 from the overhead condenser/evaporator 70 of the low pressure column 34.

The cooled first oxygen rich liquid from the subcooler 46 is then introduced into the low pressure column 34 above the bottom tray after expansion through valve 76.

The second feed air fraction which enters the condenser/reboiler 58 in the base of the low pressure column 34 is condensed by indirect heat exchange with oxygen-rich liquid at the bottom of the low pressure column 34. This causes the second feed air fraction to be condensed and the oxygen-rich liquid to be vaporized.

The condensed second feed air fraction leaves the condenser/reboiler 58 of the low pressure column 34 via line 82 where it enters subcooler 46. The liquefied air exits subcooler 46 via line 84 and expands through valve 44 into the condenser/reboiler 40 of the high pressure column 32. If needed, a portion of the condensed second feed air fraction can be introduced into the low pressure column 34 via line 90 after expansion through valve 92 to control the balance of air between the high pressure and low pressure columns.

Figure 3:
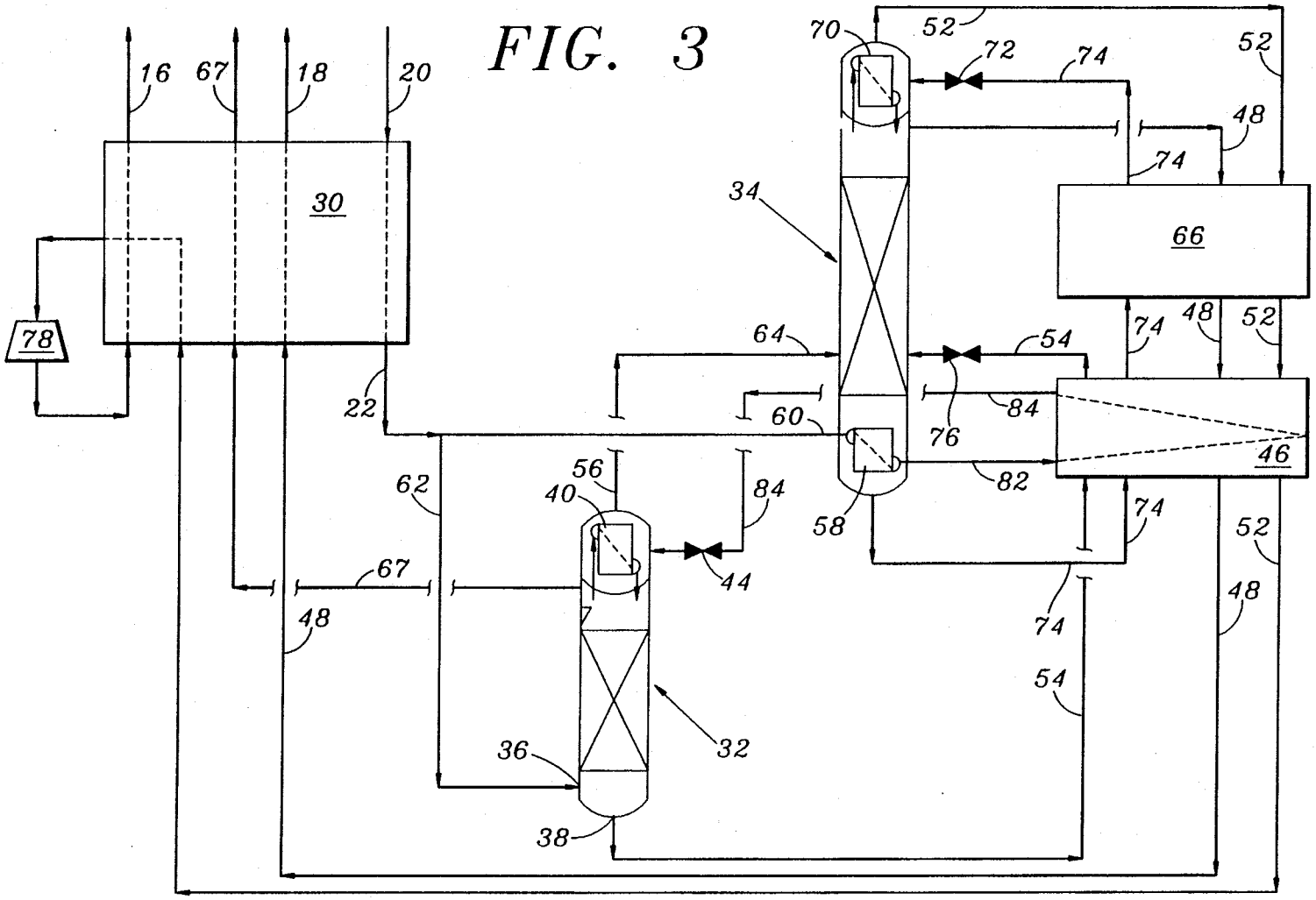
FIG. 3 shows a schematic flow diagram of the process and apparatus of the invention wherein high pressure and low pressure nitrogen are produced; and, FIG. 4 shows a schematic flow diagram of the process and apparatus of the invention similar to FIG. 3 wherein part of the high pressure nitrogen is expanded to low pressure nitrogen.
Figure 4:
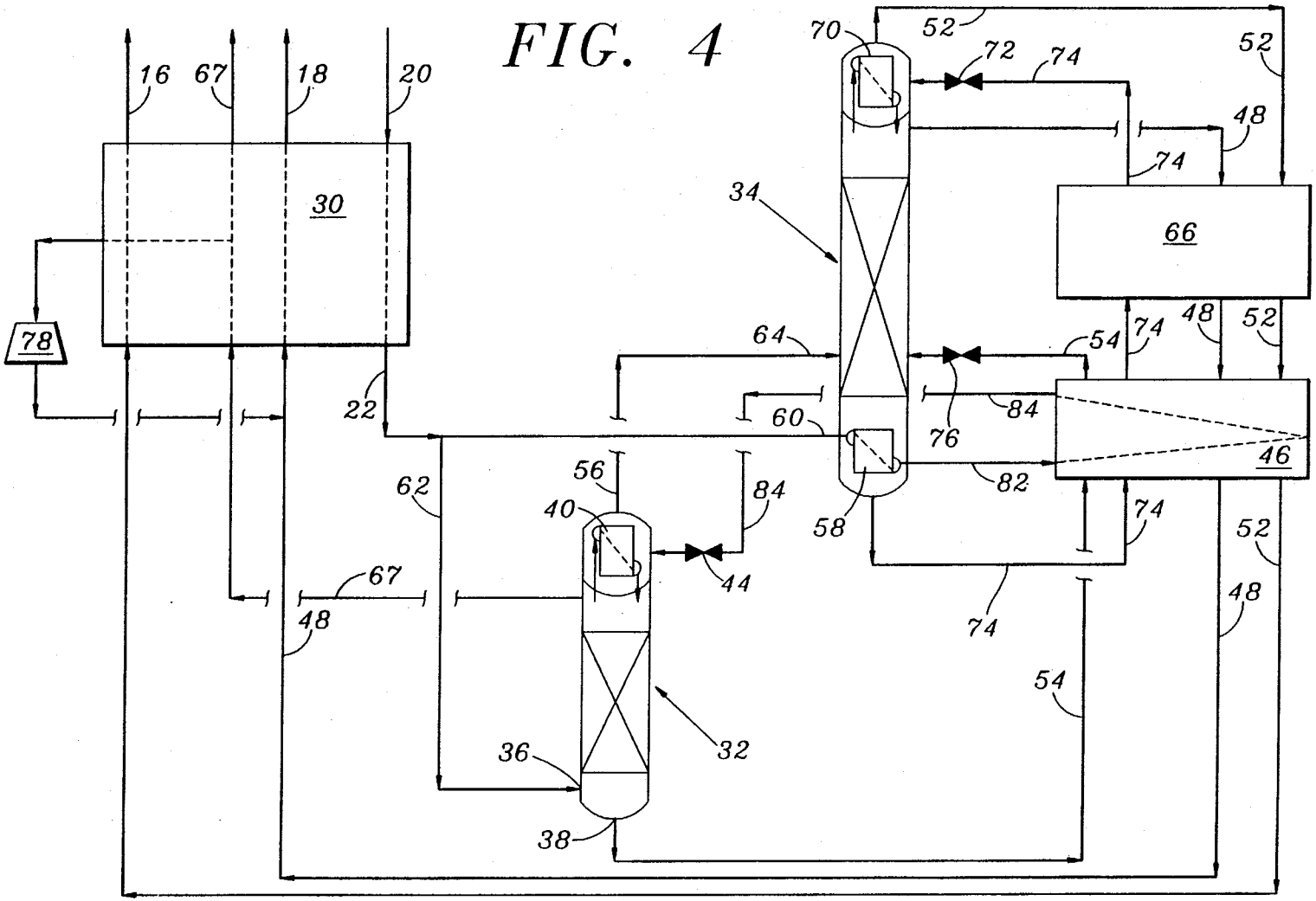

The first nitrogen-rich vapor fraction rises to the top of the high pressure column 32 where it enters the condenser/reboiler 40. Here the nitrogen vapor is brought into indirect heat exchange contact with the condensed second feed air fraction which enters through valve 44 from the condenser/reboiler 58 of the low pressure column 34. This causes the liquefied air to vaporize and the nitrogen vapor to be condensed. As shown in FIGS. 3 and 4, part or all of the condensed nitrogen portion is returned to the high pressure column 32 to provide reflux as required.

Any nitrogen vapor which is not condensed by indirect heat exchange with the condensed second feed air fraction can be recovered as high pressure nitrogen by removal from the upper part of the high pressure column 32 for example, through line 67 as shown in FIG. 3.

Part of the condensed nitrogen can be sent to the low pressure column 34 for extra reflux if the high pressure nitrogen flow is small or not needed. This part of the condensed nitrogen is removed from the upper part of the high pressure column 32 through line 68 as shown in FIGS. 1 and 3. The condensed nitrogen is then passed through subcooler 66 where it is brought into indirect heat exchange contact with outgoing nitrogen product and waste. From the subcooler 66, the condensed nitrogen passes through a continuation of line 68 and is introduced into the low pressure column 34 after expansion through valve 78.

At the same time, the vaporized air exiting via line 56 from the condenser/reboiler 40 at the top of the high pressure column 32 is separated by introduction into the low pressure column 34 through line 64 at about the same level as for the introduction of the first oxygen-rich liquid which enters through line 54.

The first oxygen-rich liquid withdrawn from the base of column 32 and the vaporized air withdrawn from the condenser/reboiler 40 at the top of the high pressure column 32 through line 56 are further separated within column 34 into a second nitrogen-rich vapor fraction and a second oxygen-rich fraction.

The second nitrogen-rich vapor fraction rises to the top of the low pressure column 34 while the second oxygen-rich fraction falls to the bottom of the low pressure column 34.

A portion of the second oxygen-enriched liquid fraction at the bottom of the low pressure column 34 is withdrawn through line 74 and passed through a first subcooler 46. Here the second oxygen-enriched liquid is further cooled by indirect heat exchange with nitrogen gas removed from the upper part of the low pressure column 34 through line 48 and with the waste stream exiting through line 52 from the overhead condenser 70 of the low pressure column 34.

The second oxygen-enriched liquid is passed by means of a continuation of line 74 to a second subcooler 66 for further cooling by indirect heat exchange with nitrogen gas removed from the top of the high pressure column 32 through line 68 and with the waste oxygen stream which exits from the overhead condenser 70 through line 52.

The resulting cooled second oxygen-rich liquid is passed through an extension of line 74 where the liquid is introduced into the overhead condenser 70 in the top of the low pressure column 34 after expansion through a valve 72 to further cool the second oxygen enriched stream.

A major part of the second nitrogen-rich stream is recovered as nitrogen product from the upper part of the low pressure column 34 through line 48. The gaseous nitrogen stream is warmed by passage through subcoolers 66 and 46 and heat exchanger 30 before exiting the system.

The remaining portion of the second nitrogen-rich stream within the low pressure column 34 is condensed by heat exchange with the second oxygen-enriched liquid in the overhead evaporator/condenser 70 of the low pressure column 34 which causes the second oxygen-enriched liquid to be vaporized. The condensation of the nitrogen provides reflux for the low pressure column 34. The vaporizing oxygen-enriched liquid exits overhead evaporator/condenser 70 via line 52 and is subsequently warmed by passage through subcoolers 66 and 46 and heat exchanger 30.

After warming in the heat exchanger 30, the waste oxygen stream is passed through a turbo expander 78 where the stream can be expanded to provide plant cooling.

It can seen that the above described process utilizes air as a heating and cooling medium between the high pressure and low pressure columns. Conventionally in prior art processes, the nitrogen-rich stream has been used to transfer heat to the bottom of the low pressure column. Keeping in mind that for a given nitrogen recovery, that is, having the same composition of oxygen-rich stream, more energy is required to condense the nitrogen-rich stream than to condense air. What this means is that for a given nitrogen recovery, using air as the heat transfer medium, the high pressure column can function at a lower pressure than for conventional prior art processes. Also, for the same pressure in the high pressure column, according to the invention process, the low pressure column can function at a higher pressure.

Table 1 below shows the expected performance of the invention process shown in FIG. 1 and above described for the products of nitrogen as product.

TABLE 1

| | | |
|---|---|---|
| Total Feed Air Flow | Line 20 | 15462 $Nm^3/h$ |
| Feed Air Pressure | Line 20 | 10.2 bar abs. |

TABLE 1-continued

| | | |
|---|---|---|
| Nitrogen Product Flow | Line 48 | 10514 $Nm^3/h$ |
| Nitrogen Pressure | Line 18 | 5.5 bar abs. |
| Nitrogen Purity | | 18 vpm 02 |
| Waste (Oxygen-Rich) Flow | Line 52 | 4948 $Nm^3/h$ |
| Waste Pressure | Line 16 | 1.3 bar abs. |
| Compressed Air | Line 22 | −160° C. |
| Column 32 | | 10.2 bar abs. |
| Column 32 | Top | −170° C. |
| Column 32 | Bottom | −160° C. |
| Oxygen-Rich Liquid | Line 38 | −165.6° C. |
| Condensed Second Feed Air Fraction | Line 82 | −167.5° C. |
| Condensed Second Feed Air Fraction | Line 82 | −167.5° C. |
| Condensed Second Feed Air Fraction | Line 84 | −171° C. |
| Vaporized Second Feed Air Fraction from Condenser/Reboiler 40 | Line 56 | −172.6° C. |
| Nitrogen Exiting Column 32 | Line 68 | −170.6° C. |
| Condensed Nitrogen Exiting Subcooler 66 | Line 68 | −174.4° C. |
| Column 34 | | 5.5. bar abs. |
| Oxygen-Rich Liquid from Column 34 | Line 74 | −168.8° C. |
| Oxygen-Rich Liquid Exiting from Cooler 66 | Line 74 | −174.4° C. |
| Oxygen-Rich Liquid after Expansion | Valve 72 | −179° C. |
| Nitrogen Product Exiting Column 34 | Line 48 | −177.6° C. |
| Nitrogen Product Exiting Column 34 | Line 48 | 5 bar abs. |
| Oxygen Waste Stream from Condenser 70 | Line 52 | −178.5° C. |

When the embodiment shown in FIG. 3 or FIG. 4 is followed, a feed air pressure of 21 bar abs. would produce a pressure of about 20 bar abs. within the high pressure column 32 and a pressure of about 14 bar abs. within the low pressure column 34.

Various modifications of the invention process and apparatus as above described will be apparent to those skilled in the art and can be resorted to without departing from the spirit and scope of the invention as defined by the following appended claims.

I claim:

1. In a process for the cryogenic separation of air by rectification in at least one distillation column to produce at least one vapor fraction, at least one liquid fraction, and at least one product nitrogen stream the improvement comprising:

providing a cooled and pressurized feed air stream in vapor form;

condensing at least a portion of said feed air vapor stream by indirect heat exchange contact with at least one of said liquid fractions to vaporize said liquid fraction and condense said feed air stream; and vaporizing a portion of said condensed feed air stream by indirect heat exchange contact with one of said vapor fractions thereby condensing said vapor fraction.

2. The process of claim 1 wherein said vaporized feed air stream is further introduced into one of said distillation columns as feed air for cryogenic separation by rectification.

3. In a process for producing nitrogen by cryogenic distillation of air in a high pressure distillation column to produce a first oxygen-rich fraction and a first nitrogen-rich liquid fraction; and introducing at least a portion of said first oxygen-rich fraction into a low pressure distillation column to produce a second oxygen-rich fraction and a second nitrogen-rich fraction by cryogenic distillation, the improvement which comprises:

bringing cooled feed air into indirect heat exchange contact with said second oxygen-rich fraction to vaporize at least a portion of said second oxygen-rich fraction and condense at least a portion of said air;

bringing said condensed portion of said feed air into indirect heat exchange contact with said first nitrogen-rich fraction to condense said first nitrogen-rich fraction and to vaporize said condensed portion of said feed air; and, introducing said vaporized portion of said feed air into said low pressure distillation column for cryogenic separation.

4. A process as claimed in claim 3 further comprising:

separating feed air into a first feed air fraction which is introduced into said high pressure column for cryogenic separation and a second feed air fraction which is brought into indirect heat exchange relation with said second oxygen-rich fraction to vaporize at least a portion of said second oxygen-rich fraction and condense at least a portion of said second feed air fraction;

passing said condensed second feed air fraction into indirect heat exchange relation with said first nitrogen-rich fraction to condense said first nitrogen rich fraction and vaporize said condensed second feed air fraction; and, introducing said vaporized second feed air fraction into said low pressure column for cryogenic separation.

5. A cryogenic process for producing nitrogen from air comprising:

A) Dividing cooled compressed feed air substantially free of moisture and impurities into a first feed air fraction and a second feed air fraction;

B) Feeding said first feed air fraction into a high pressure column equipped with a top condenser;

C) Separating said first feed air fraction within said high pressure column by cryogenic distillation into a first nitrogen-rich fraction and a first oxygen-rich fraction;

D) Withdrawing at least a protion of said first oxygen-rich fraction from said high pressure column;

E) Introducing at least a portion of said first oxygen-rich fraction into a low pressure column equipped with a bottom condenser/reboiler and an overhead evaporator/condenser for cryogenic separation into a second nitrogen-rich fraction and a second oxygen-rich fraction;

F) Introduccing said second feed air fraction into said consenser/reboiler in said low pressure column;

G) Condensing said second feed air fraction by indirect heat exchange with said second oxygen-rich fraction in said low pressure column thereby vaporizing at least a portion of said second oxygen-rich fraction;

H) Introducing at least a portion of said condensed second feed air fraction into said top condenser of said high pressure column;

I) Vaporizing at least a portion of said second condensed feed air fraction within said top condenser of said high pressure column by indirect heat exchange with at least a portion of said first nitrogen-rich fraction in said high pressure column to condense at least a portion of said first nitrogen-rich fraction;

J) Introducing into said low pressure column at least a portion of said second feed air fraction vaporized by indirect heat exchange contact with said first nitrogen-rich fraction in said top condenser of said high pressure column for cryogenic separation together with at least a portion of said first oxygen-rich fraction into a second nitrogen-rich fraction and a second oxygen-rich fraction;

K) Removing at least a portion of said second nitrogen-rich fraction as product from said low pressure column;

L) Withdrawing at least a portion of said condensed second oxygen-rich fraction from said low pressure column;

M) Introducing at least a portion of said withdrawn oxygen-rich fraction into said overhead condenser of said low pressure column;

N) Vaporizing at least a portion of said second oxygen-rich fraction in said overhead condenser by indirect heat exchange with at least a portion of said rising second nitrogen-rich fraction within said low pressure column thereby causing said second nitrogen-rich fraction to be condensed and providing reflux for said low pressure column; and, O) Withdrawing at least a portion of said vaporized second oxygen-rich fraction from said overhead condenser as waste.

6. A process as claimed in claim 5 further comprising:

withdrawing at least a portion of said condensed first nitrogen-rich fraction from said high pressure column as high pressure nitrogen product.

7. A process as claimed in claim 6 further comprising:

expanding at least a portion of said waste oxygen withdrawn from said overhead condenser to provide plant cooling.

8. A process as claimed in claim 6 further comprising:

expanding at least a portion of said high pressure nitrogen product prior to discharge with said low pressure nitrogen product.

9. A process as claimed in claim 5 further comprising:

withdrawing at least a portion of said condensed first nitrogen-rich fraction from said high pressure column; and, introducing at least a portion of said withdrawn condensed first nitrogen-rich fraction into said low pressure column.

10. A process as claimed in claim 5 further comprising:

further dividing said compressed feed air into a third feed air fraction;

expanding at least a portion of said third feed air fraction to provide cooling; and, introducing at least a portion of said expanded feed air fraction into said low pressure column.

11. A process as claimed in claim 5 further comprising:

cooling said feed air by indirect heat exchange contact with waste and product streams; and, compressing said feed air to provide a pressure in the high pressure column in the range of about 2 bar to about 20 bar.

12. A process as claimed in claim 5 wherein:

said first feed air fraction in step B) is fed into the lower half of said high pressure column; and, said first oxygen-rich fraction in step D) is withdrawn from the base of said high pressure column.

13. A process as claimed in claim 5 wherein:

said first oxygen-rich fraction of step E) is introduced into the lower half of said low pressure column; and, said second oxygen-rich fraction of step N) is withdrawn from the base of said low pressure column.

14. A process as claimed in claim 5 further comprising:

passing said waste oxygen obtained in step Q) through a turbo expander to provide cooling; and warming said cooled waste oxygen from said turbo expander by indirect heat exchange contact with feed air which is thereby cooled.

15. Apparatus for producing nitrogen from cooled compressed air comprising:

a first distillation column equipped with a top column condenser for cryogenic separation by fractionation of a portion of said cooled compressed feed air into a first nitrogen-rich fraction and a first oxygen-rich fraction;

a second distillation column equipped with a top column condenser and a bottom column reboiler for separation by fractionation of at least a portion of the cooled compressed feed air after circulation through said bottom column reboiler of said second distillation column and said top column condenser of said first distillation column together with at least a portion of said first oxygen-rich obtained from said first distillation column into a second oxygen-rich fraction and a second nitrogen-rich fraction;

conduit means within said first and said second distillation columns for the introduction and withdrawal of liquids and vapors;

conduit means in communication between said first and said second distillation columns for introduction and withdrawal of liquids and vapors;

conduit means in communication with said bottom column reboiler of said second distillation column for the introduction of cooled compressed feed air;

conduit means in communication with said bottom column reboiler of said second distillation column and said top column condenser of said first distillation column for transfer of condensed feed air from said reboiler in said second distillation column to said top column condenser in said first distillation column;

conduit means in communication with said top column condenser of said first distillation column and said second distillation column for withdrawal of vaporized air from said top column condenser of said first distillation column and introduction into said second distillation column for cryogenic separation; and, conduit means in communication with said first distillation column and said second distillation column for withdrawal of at least a portion of said first oxygen-rich fraction from the bottom of said first distillation column and introduction into said second distillation column for cryogenic separation.

16. Apparatus as claimed in claim 15 further comprising:

conduit means in communication with said second distillation column and said top column condenser of said second distillation column for withdrawal of said oxygen-rich fraction from said second distillation column and introduction into said top column condenser of said second distillation column to provide indirect heat exchange with vapors rising within said second distillation column;

conduit means in communication with said top column condenser of said second distillation column for withdrawal of said second oxygen-rich fraction as waste; and, conduit means in communication with said first distillation column and said second distillation column for withdrawal of said first nitrogen-rich fraction from said first distillation column and introduction into said second distillation column to provide reflux for said second distillation column.

17. Apparatus as claimed in claim 16 further comprising:

compression means for compressing air from an outside source;

purification means for removing carbon dioxide, water vapor and other impurities from air compressed by said air compression means;

heat exchange means for cooling the compressed air from said purification means to a cryogenic temperature;

conduit means in communication with said top column condenser of said second distillation column for the introduction and withdrawal of liquids and vapors;

conduit means in communication with said heat exchanger and said first distillation column and said second distillation column for the introduction of cooled compressed feed air; and, valve means within at least one of said conduit means for metering of vapors and liquids and for expansion therethrough.

18. Apparatus as claimed in claim 15 further comprising:

conduit means in communication with said first distillation column and said heat exchange means for withdrawal of nitrogen product.

19. Apparatus as claimed in claim 18 further comprising:

expansion means in communication with said conduit means for expansion of at least a portion of nitrogen product to provide cooling.

20. Apparatus as claimed in claim 15 further comprising:

expansion means for expansion of oxygen waste.

21. An apparatus as claimed in claim 15 further comprising expansion means for expansion of cooled compressed air prior to introduction into said second distillation column to provide cooling.

* * * * *